US008324532B2

(12) United States Patent
Sterling et al.

(10) Patent No.: US 8,324,532 B2
(45) Date of Patent: Dec. 4, 2012

(54) VEHICLES INCLUDING REAR DEFROSTER ASSEMBLIES WITH PROTECTIVE BARRIERS

(75) Inventors: Andrea L. Sterling, Ann Arbor, MI (US); Corey B. Sargent, Royal Oak, MI (US); Mark T. Bacchus, Ypsilanti, MI (US); Scott M. Ankeny, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 408 days.

(21) Appl. No.: 12/691,096

(22) Filed: Jan. 21, 2010

(65) Prior Publication Data

US 2011/0174796 A1 Jul. 21, 2011

(51) Int. Cl.
*H05B 3/04* (2006.01)

(52) U.S. Cl. ..... 219/203; 219/202; 219/522; 219/544; 219/546

(58) Field of Classification Search ..... 219/202, 219/203, 522, 544, 546–547
See application file for complete search history.

(56) References Cited

U.S. PATENT DOCUMENTS

| | | | | |
|---|---|---|---|---|
| 3,180,781 | A | 4/1965 | Ryan et al. | |
| 3,781,524 | A | 12/1973 | Levin | |
| 3,909,331 | A | 9/1975 | Cohen | |
| 3,947,618 | A * | 3/1976 | Gruss | 428/49 |
| 4,755,659 | A * | 7/1988 | Leon et al. | 219/547 |
| 5,099,104 | A | 3/1992 | Holzer et al. | |
| 5,122,403 | A | 6/1992 | Roginski et al. | |
| 7,129,444 | B2 | 10/2006 | Weiss | |
| 7,297,902 | B2 * | 11/2007 | Weiss | 219/203 |
| 2006/0196865 | A1 * | 9/2006 | Weiss | 219/203 |
| 2007/0137141 | A1 | 6/2007 | Petersen et al. | |
| 2007/0187391 | A1 * | 8/2007 | Weiss et al. | 219/522 |
| 2008/0028697 | A1 * | 2/2008 | Li et al. | 52/171.2 |
| 2008/0268672 | A1 * | 10/2008 | Sargent et al. | 439/78 |
| 2008/0274652 | A1 * | 11/2008 | Li et al. | 439/733.1 |
| 2009/0166347 | A1 * | 7/2009 | Blanchard et al. | 219/201 |

* cited by examiner

*Primary Examiner* — Allan R Wilson
(74) *Attorney, Agent, or Firm* — Dinsmore & Shohl LLP

(57) ABSTRACT

A vehicle includes a rear window and a defroster assembly including heating lines extending across the rear window. A protective barrier at least partially covers the heating lines. The protective barrier includes a film that provides a barrier between the heating lines and sulfur gases generated by components of the vehicle.

13 Claims, 6 Drawing Sheets

VEHICLES INCLUDING REAR DEFROSTER ASSEMBLIES WITH PROTECTIVE BARRIERS

TECHNICAL FIELD

The present specification generally relates to vehicles including rear defroster assemblies and, more particularly to vehicles including rear defroster assemblies with protective barriers.

BACKGROUND

Many conventional vehicles include rear defroster assemblies that are used to clear (e.g., defog and/or de-ice) the rear window of the vehicle. Many such defroster assemblies are electrically operated and utilize heating elements that extend across the rear window. For various reasons, the heating elements may become damaged and inoperable such that they are no longer effective in clearing the rear window. Accordingly, rear defroster assemblies are desired having improved resistance to damage.

SUMMARY

In one embodiment, a vehicle includes a rear window and a defroster assembly including heating lines extending across the rear window. A protective barrier at least partially covers the heating lines. The protective barrier includes a film that provides a barrier between the heating lines and sulfur gases generated by components of the vehicle.

In another embodiment, a method of protecting a vehicle defroster assembly from corrosion is provided. The method includes covering heating lines extending across a window of a vehicle with a film suitable for providing a barrier to sulfur gases; and providing an opening in the clear film sized and arranged to receive a connecting tab therethrough that is electrically connected to a bus bar of the defroster assembly.

In another embodiment, a combination rear window with defroster assembly for a vehicle includes a plurality of heating lines that extend across the rear window for providing surface heating of the rear window during operation. A film at least partially covers the heating lines. The film is configured to provide a barrier between the heating lines and sulfur gases generated by components of the vehicle.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein generally relate to defroster assemblies for vehicles and methods for protecting rear defroster assemblies from damage. The rear defroster assemblies typically include a plurality of defroster lines that run widthwise (or otherwise) across a rear window of the vehicles. The defroster lines provide surface heating to the window sufficient to clear the window of fog and frost. As will be described herein, a protective layer may be applied over the defroster lines (and/or other defroster assembly elements) to protect the defroster lines from environmental compounds, such as sulfur, which may damage (e.g., corrode) the defroster lines over time when exposed thereto.

Figure 1:
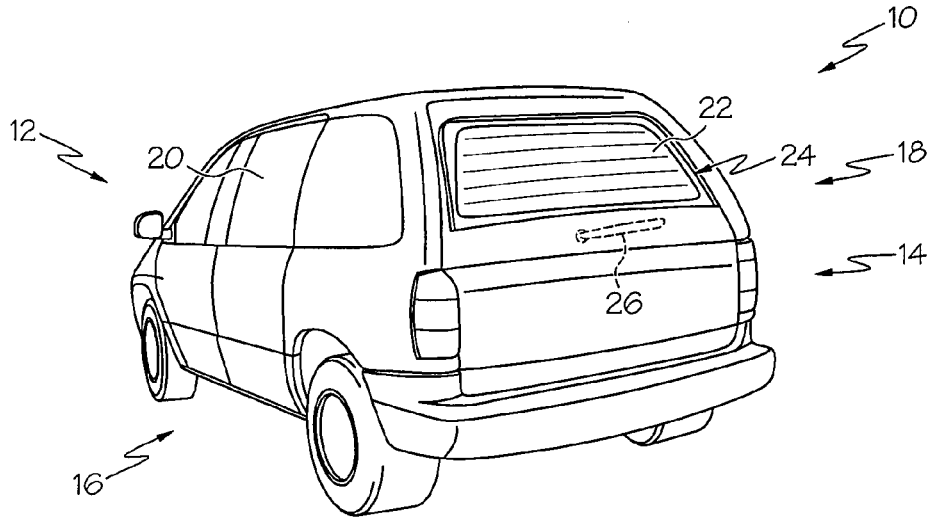
FIG. 1 is a perspective view of an embodiment of a vehicle including defroster assembly according to one or more embodiments shown and described herein.

Referring to FIG. 1, a vehicle 10 generally includes a front 12, a rear 14 and sides 16 and 18 extending from the front 12 to the rear 14. A front window (not shown) is located at the front 12 of the vehicle, side windows 20 are located at the sides 16 of the vehicle 10 and a rear window 22 is located at the rear 14 of the vehicle 10. The vehicle 10 includes a defroster assembly 24 that is used to clear (e.g., defog and/or de-ice) the rear window 22. In some embodiments, a windshield wiper mechanism 26 (shown by dashed lines) may be provided at the rear window 22 for use in clearing the rear window 22. While a minivan-type vehicle is illustrated in FIG. 1 other vehicle types may be suitable for including the defroster assembly, such as cars, trucks, SUVs, etc.

Figure 2:
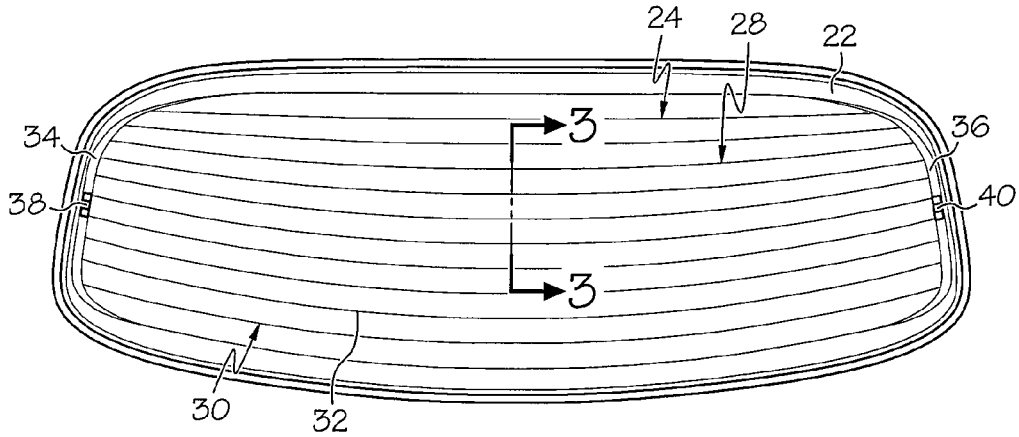
FIG. 2 illustrates an interior view of a window with defroster assembly according to one or more embodiments shown and described herein.

FIG. 2 illustrates an interior side 28 of the rear window 22 including the defroster assembly 24. The defroster assembly 24 may generally include a grid 30 of horizontal heating lines 32 extending widthwise along the interior side 28 of the rear window 22. In some embodiments, the heating lines 32 may be substantially parallel, however, other parallel and non-parallel arrangements are possible. For example, in some embodiments, there may be both horizontal and vertical heating lines. Bus bars 34 and 36 extend vertically that are electrically connected to opposite ends of the heating lines 32. Connecting tabs 38 and 40 are electrically connected to the bus bars 34 and 36, respectively. The connecting tabs 38 and 40 are each shaped to be electrically connected to a main connector, which can be used to complete the electrical circuit for the defroster assembly 24. In some embodiments, the connecting tabs 38 and 40 may be soldered to the bus bars 34 and 36, however, other suitable connections may be used. In some embodiments, the heating lines 32 and the bus bars 36 may be formed of a conductive material such as silver or a combination of materials such as a silver ceramic material that is applied to the rear window 22 by any suitable method such as depositing the conductive material onto the rear window 22 and heating or baking the material in place.

Figure 3:
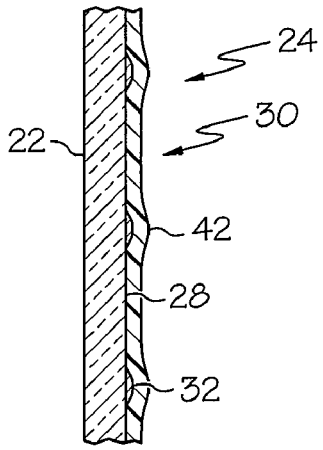
FIG. 3 illustrates a section view of the window with defroster assembly along lines 3-3 of FIG. 2 according to one or more embodiments shown and described herein.

Referring to FIG. 3, a side, section view of the rear window 22 with the defroster assembly 24 is shown. The defroster assembly 24 further includes a protective layer 42 that covers the interior side 28 of the rear window 22 including the grid 30 of horizontal heating lines 32. The protective layer 42 may be formed of a material (e.g., such as a clear polyester film or other suitable film material) that can be used to protect the conductive elements of the defroster assembly 24 from environmental compounds such as sulfur, as will be described below.

Figure 4:
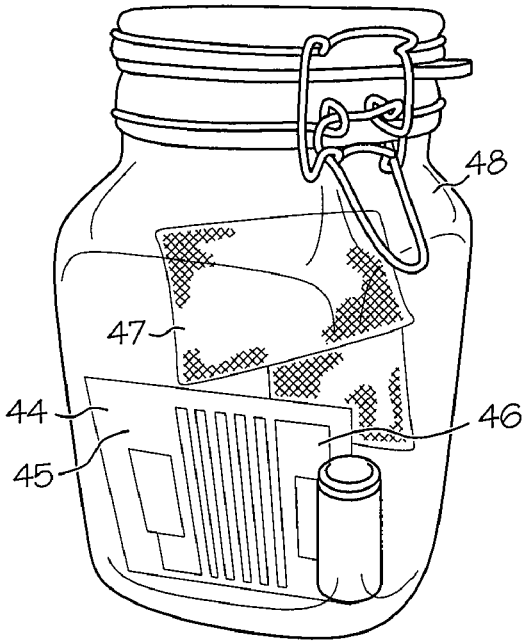
FIG. 4 illustrates a system for testing change in resistance of defroster lines according to one or more embodiments shown and described herein.

Without wishing to be bound by theory, various components of the vehicle 10 formed of rubber (e.g., such as roof fabric) may contain sulfur and/or sulfur compounds used in the curing process, which may be released as gases (e.g., $SO_2$, $S_{(g)}$, $H_2S$), for example, when the rubber material is heated. Referring to FIG. 4, tests were conducted exposing various test samples 44 including glass panels 45 with defroster lines 46 formed thereon to sulfur gases generated from a rubber containing fabric 47 at a temperature of about 80° C. The test samples 44 and rubber containing fabric 47 were placed in a closed container 48 for 400 hours that was sealed from the environment and water was added for a 95% relative humidity level.

Figure 5:
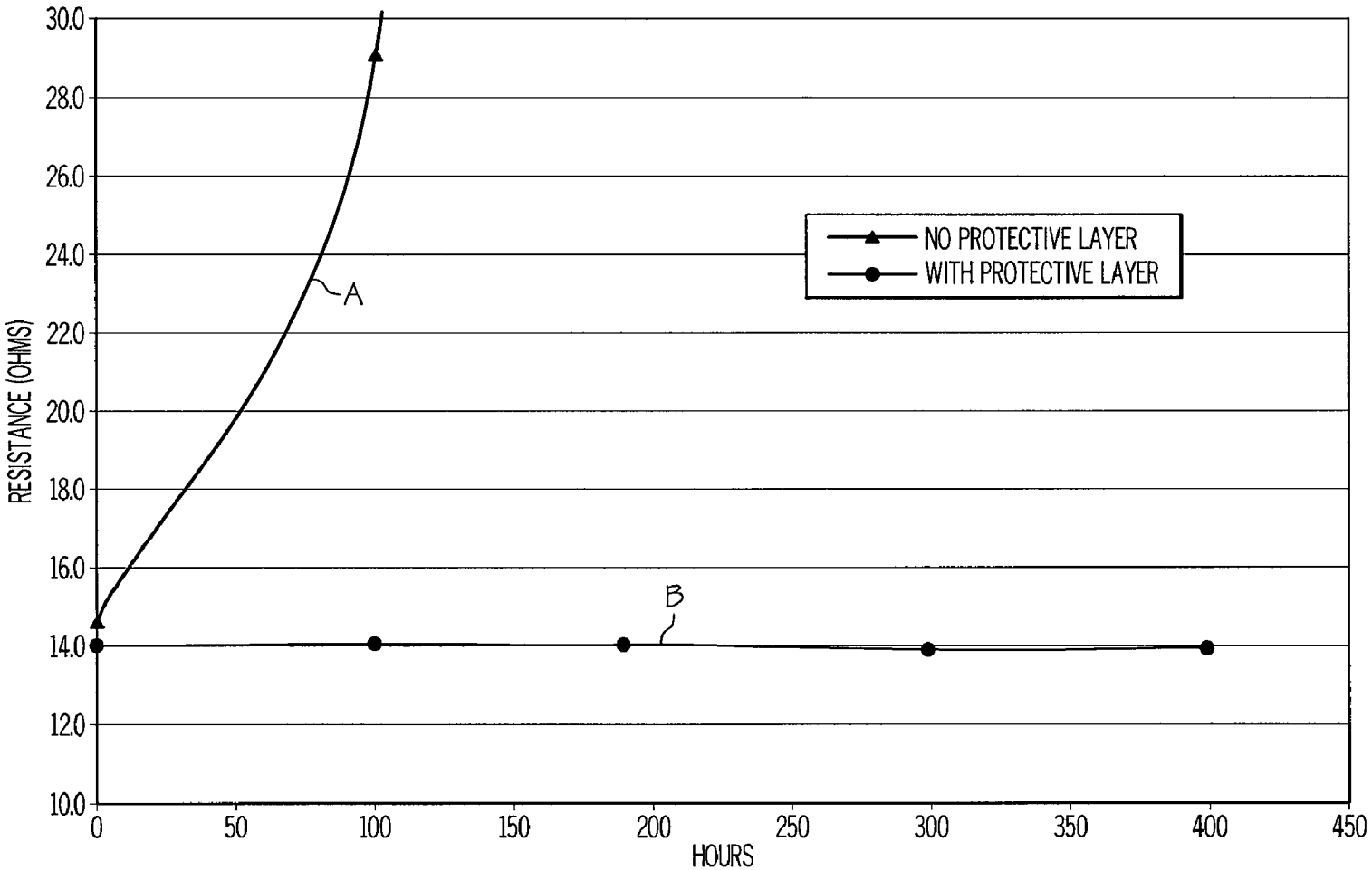
FIG. 5 illustrates a chart showing change in resistance of defroster lines with and without a barrier material according to one or more embodiments shown and described herein.

Referring to FIG. 5, as can be seen from plot A, it was found from the above test that the resistance of defroster lines formed of a silver material increases rapidly as the defroster lines are exposed to sulfur gases generated from the rubber containing fabric. It was also found that covering the defroster lines with a suitable film material (e.g., such as a clear polyester residential window film) may prevent an increase in the resistance of the defroster lines formed of the silver material by reducing or eliminating their exposure to the sulfur gases. As can be seen by plot B of FIG. 5, resistance of defroster lines of a test sample covered with the film material may exhibit a greatly reduced increase in resistance of less than about one ohm over a period of 400 hours when placed in an environment containing sulfur gases. In some embodiments, the resistance of the defroster lines of the test sample increased less than about 10 percent, such as less than about five percent, such as less than about four percent.

Figure 6:
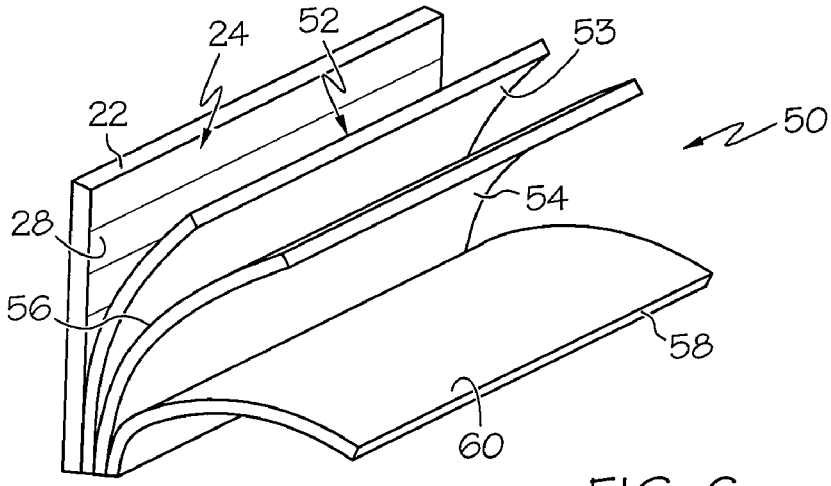
FIG. 6 illustrates an exploded view of a protective barrier applied to a window according to one or more embodiments shown and described herein.

Referring to FIG. 6, a section view of one exemplary embodiment of the rear window 22 including defroster assembly 24 and a flexible window film 50 is shown. In the embodiment of FIG. 6, the window film 50 may include a mounting adhesive layer 52 (e.g., formed of a UV absorbing adhesive) facing the interior side 28 of the rear window 22 that is formed on a first layer 53 of a clear polyester film. A second layer 54 of clear polyester film may be adhered to the first layer 53 using a laminating adhesive layer 56 therebetween. A third layer 58 of clear polyester film may be adhered to the second layer 54 using a laminating adhesive layer 60 therebetween and a protective scratch resistant coating may be applied to an outer surface of the third layer 58. While three layers of polyester film are shown by FIG. 6, there may be more or less than three layers of polyester film.

As used herein, the term "clear" may refer to films having a visible light transmittance of about 70 percent or more, such as about 75 percent or more, such as about 80 percent or more, such as about 90 percent or more. In some embodiments, the window film 50 may have one or more of the following properties: a peel strength of about 2,000 g/in or more, a tensile strength of about 20,000 lbs/sq in or more, a break strength of about 200 lbs/in or more, a percent elongation at break of about 150% or more and a melting point of about 250° C. or more. The window film 50 may be between, for example, 4 and 14 mils in thickness.

Figure 7:
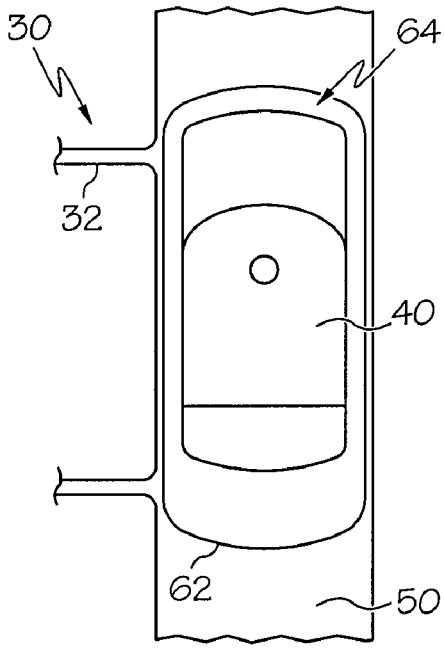
FIG. 7 illustrates an interior view of a connecting tab received in an opening in the protective barrier according to one or more embodiments shown and described herein.

Referring now to FIG. 7, while any suitable method or process may be used to apply the window film 50 to over the defroster assembly 24 and the grid 30 of horizontal heating lines 32, an opening 62 may be formed in the window film 50 that is sized and located to allow the connecting tabs 38 and 40 to be exposed therethrough for connection to the main electrical connector. As can be seen by FIG. 7, the opening 62 may be sized larger in both height and width than the connecting tabs 38 and 40 forming a gap 64 between the connecting tabs 38 and 40 and the respective opening 62 to provide clearance for the connecting tabs 38 and 40 and to facilitate application of the window film 50.

Figure 8:
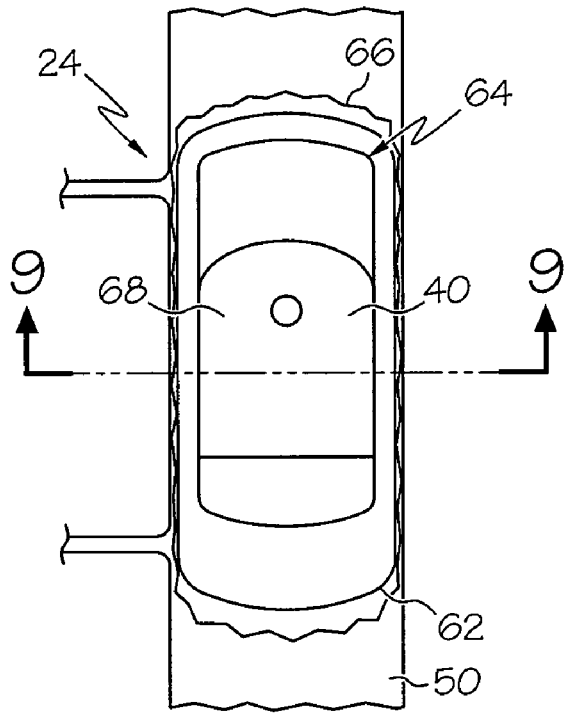
FIG. 8 illustrates the connecting tab and protective barrier of FIG. 7 with a barrier material applied to the opening according to one or more embodiments shown and described herein.
Figure 9:
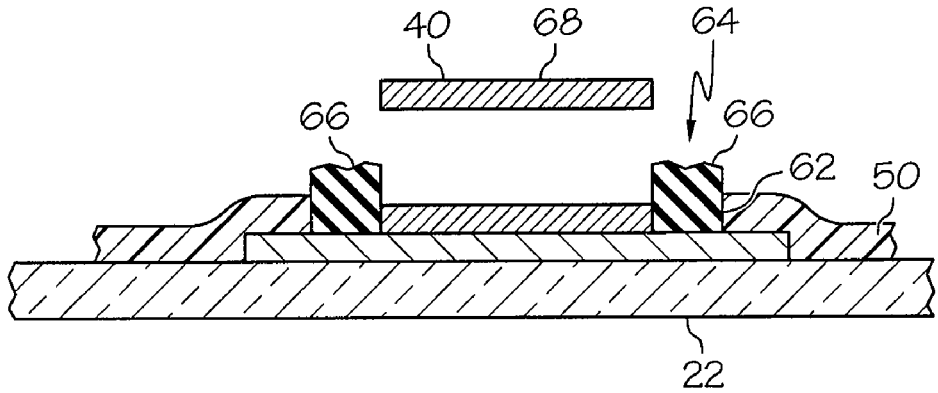
FIG. 9 is a section view of the connecting tab and protective barrier along lines 9-9 of FIG. 8 according to one or more embodiments shown and described herein.

Referring to FIGS. 8 and 9, a barrier material 66 may be applied about the connecting tabs 38 and 40 to cover the gap 64 between the connecting tabs 38 and 40 and the respective openings 62 in the window film 50. The barrier material 66 may be of a material different than that forming the window film 50, which may be a material selected to protect the conductive elements of the defroster assembly 24 from environmental compounds such as sulfur. As one example, the barrier material 66 may include an epoxy resin (e.g., a bisphenol-A diglycidyl ether resin) that hardens in place after applied to the gap 64. Once the barrier material 66 hardens, a barrier against sulfur reaction may be formed. As can be seen by FIGS. 8 and 9, the barrier material 66 may be applied about the entire periphery of the connecting tabs 38 and 40 while leaving a connecting portion 68 of the connecting tabs 38 and 40 exposed for connecting to the main electrical connector. In some embodiments, no barrier material 66 is applied over the heating lines 32.

Figure 10:
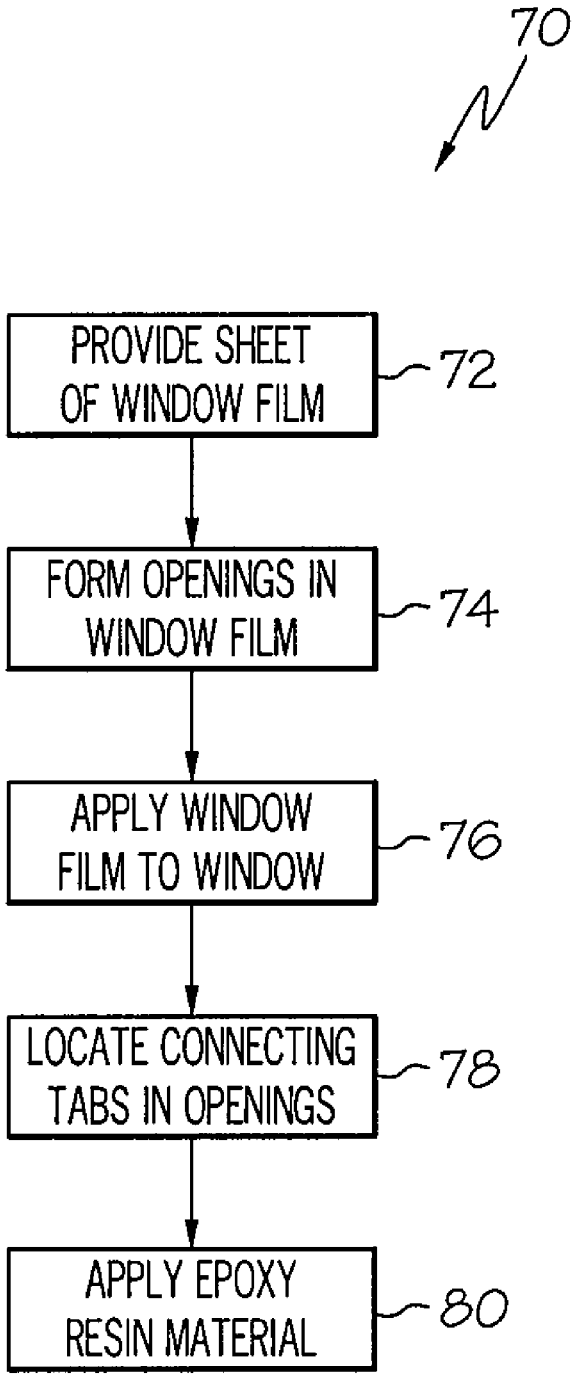
FIG. 10 illustrates a method of providing a protective barrier to a rear window for protecting a defroster assembly according to one or more embodiments shown and described herein.

Referring to FIG. 10, an exemplary method 70 of providing a protective barrier to a rear window for protecting a defroster assembly includes cutting a roll of window film to a size to provide a sheet of window film sized to cover the interior surface of the rear window at step 72. At step 74, openings are cut into the sheet of window film that are sized and arranged to allow the connecting tabs to be received therethrough. The sheet of window film is then applied to the interior surface of the rear window and over the components of the defroster assembly, such as the heating lines and bus bars, using an adhesive backing layer of the window film, thereby sandwiching the components of the defroster assembly between the window and the window film at step 76. At step 78, the connecting tabs are received within the openings in the window film thereby exposing the connecting tabs for connection to a main electrical connector. An epoxy resin is applied to a gap formed between the connecting tabs and the openings in the window film and is allowed to harden at step 80. Once the window film and the epoxy resin is applied, a barrier is formed inhibiting exposure of the defroster components to the environment including sulfur gases, which can cause corrosion.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A vehicle comprising:

a rear window;

a defroster assembly including heating lines extending across the rear window, the defroster assembly comprising a bus bar electrically connected to the heating lines;

a protective barrier at least partially covering the heating lines, the protective barrier comprising a film that provides a barrier between the heating lines and sulfur gases generated by components of the vehicle, the bus bar being at least partially covered by the protective barrier;

a connecting tab electrically connected to the bus bar, the film having an opening that is sized and arranged to receive the connecting tab such that the connecting tab is exposed outside the film; and a barrier material different from the film covering a gap formed between the connecting tab and the film.

2. The vehicle of claim 1, wherein the film is a clear plastic film.

3. The vehicle of claim 1, wherein the film comprises a layer of clear polyester film.

4. The vehicle of claim 1, wherein the barrier material comprises an epoxy resin that is located about a periphery of the connecting tab.

5. A combination rear window with defroster assembly for a vehicle, the combination comprising:

a plurality of heating lines extending across the rear window for providing surface heating of the rear window during operation;

a film at least partially covering the heating lines, the film configured to provide a barrier between the heating lines and sulfur gases generated by components of the vehicle;

a bus bar electrically connected to the heating lines, the bus bar being at least partially covered by the film;

a connecting tab electrically connected to the bus bar, the film having an opening that is sized and arranged to receive the connecting tab such that the connecting tab is exposed outside the film; and a hardened barrier material different from the film covering a gap formed between the connecting tab and the film.

6. The combination of claim 5, wherein the film is a clear plastic film.

7. The combination of claim 5, wherein the film comprises a layer of clear polyester film.

8. The combination of claim 5, wherein the hardened barrier material comprises an epoxy resin that is located about a periphery of the connecting tab.

9. The combination of claim 8, wherein the epoxy resin is a bisphenol-A diglycidyl ether resin.

10. A method of protecting a vehicle defroster assembly from corrosion, the method comprising:

covering heating lines extending across a window of a vehicle with a film suitable for providing a barrier to sulfur gases;

providing an opening in the film sized and arranged to receive a connecting tab therethrough that is electrically connected to a bus bar of the defroster assembly; and applying a barrier material that is different from the film covering a gap formed between the connecting tab and the film.

11. The method of claim 10, wherein the opening is a first opening in the film and the connecting tab is a first connecting tab, wherein the method comprises providing a second opening in the film sized and arranged to receive a second connecting tab therethrough.

12. The method of claim 10, wherein the barrier material comprises an epoxy resin.

13. The method of claim 10, wherein the film provides the barrier for the heating lines covered thereby to prevent an increase in resistance of the heating lines of about 5 percent or less.

* * * * *

UNITED STATES PATENT AND TRADEMARK OFFICE

CERTIFICATE OF CORRECTION

PATENT NO. : 8,324,532 B2
APPLICATION NO. : 12/691096
DATED : December 4, 2012
INVENTOR(S) : Andrea L. Sterling et al.

It is certified that error appears in the above-identified patent and that said Letters Patent is hereby corrected as shown below:

Title Page, (75) Inventors: Change "Scott M. Ankeny" to --Scott M. Ankeney--.

Signed and Sealed this
Nineteenth Day of March, 2013

Teresa Stanek Rea

Teresa Stanek Rea
*Acting Director of the United States Patent and Trademark Office*